US008076861B2

(12) United States Patent
Terashima et al.

(10) Patent No.: US 8,076,861 B2
(45) Date of Patent: Dec. 13, 2011

(54) DRIVING METHOD AND DRIVING DEVICE FOR DISCHARGE LAMP, LIGHT SOURCE DEVICE, AND IMAGE DISPLAY DEVICE

(75) Inventors: Tetsuo Terashima, Chino (JP); Kentaro Yamauchi, Ashiya (JP); Takeshi Takezawa, Matsumoto (JP); Kazuo Okawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 456 days.

(21) Appl. No.: 12/389,747

(22) Filed: Feb. 20, 2009

(65) Prior Publication Data

US 2009/0212711 A1 Aug. 27, 2009

(30) Foreign Application Priority Data

Feb. 26, 2008 (JP) ..... 2008-044433

(51) Int. Cl.
*H05B 41/36* (2006.01)
*H05B 41/24* (2006.01)

(52) U.S. Cl. ..... 315/209 R; 315/246

(58) Field of Classification Search ..... 315/209 R, 315/246, 307, 291, 287; 345/212
See application file for complete search history.

(56) References Cited

U.S. PATENT DOCUMENTS 6,815,907 B2 11/2004 Riederer
2007/0228996 A1 * 10/2007 Sugaya ..... 315/247
2008/0024853 A1 * 1/2008 Tanaka et al. ..... 359/238

FOREIGN PATENT DOCUMENTS

JP 2004-525496 T 8/2004
WO WO-02/091806 11/2002

* cited by examiner

*Primary Examiner* — Daniel D Chang
(74) *Attorney, Agent, or Firm* — AdvantEdge Law Group, LLC

(57) ABSTRACT

A method for driving a discharge lamp that lights by performing discharge between two electrodes while alternately switching a polarity of a voltage applied between the two electrodes includes: modulating an anode duty ratio, which is a ratio of an anode time for which one of the electrodes operates as an anode in one period of the polarity switching, by setting first and second periods with different anode duty ratios; and setting the first period, in which the anode duty ratio is higher than that in the second period, longer than the second period in one modulation period, which includes the first and second periods and for which the modulation is performed, when a predetermined condition is satisfied.

11 Claims, 16 Drawing Sheets

TIP OF DISCHARGE ELECTRODE IN INITIAL STATE

TIP OF DISCHARGE ELECTRODE THAT HAS DETERIORATED

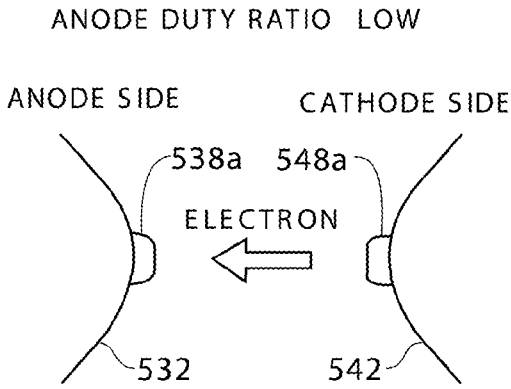
FIG. 12A
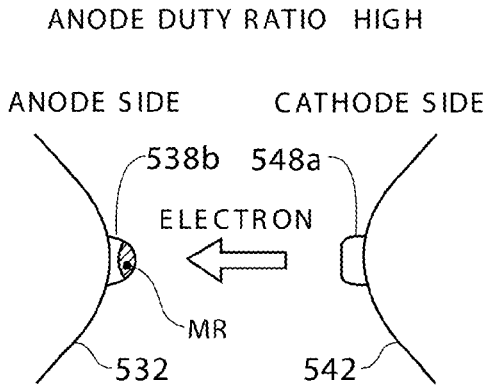
FIG. 12B
FIG. 12C
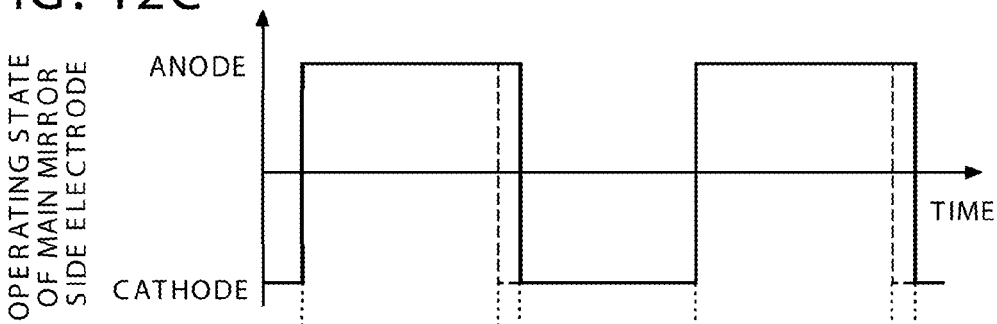
FIG. 12D
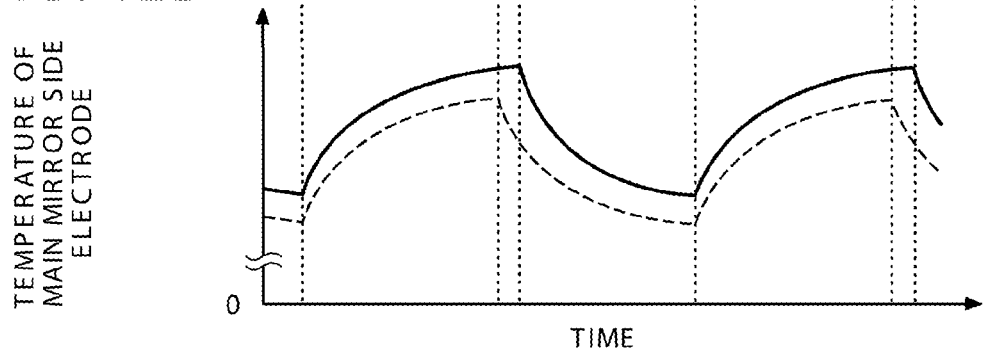

DRIVING METHOD AND DRIVING DEVICE FOR DISCHARGE LAMP, LIGHT SOURCE DEVICE, AND IMAGE DISPLAY DEVICE

BACKGROUND

1. Technical Field

The present invention relates to a technique of driving a discharge lamp that lights by discharge between electrodes.

2. Related Art

A high-intensity discharge lamp, such as a high-pressure gas discharge lamp, is used as a light source for an image display device, such as a projector. As a method of making the high-intensity discharge lamp light, an alternating current (AC lamp current) is supplied to the high-intensity discharge lamp. Thus, in order to improve the stability of light arc occurring within a high-intensity discharge lamp when supplying an AC lamp current to make the high-intensity discharge lamp light, JP-T-2004-525496 proposes to supply to the high-intensity discharge lamp an AC lamp current which has an almost constant absolute value and of which a pulse width ratio between a pulse width of a positive pulse and a pulse width of a negative pulse is modulated.

However, even if the high-intensity discharge lamp is made to light by performing pulse width modulation of the AC lamp current, it may be difficult to stabilize the light arc depending on a state of an electrode of the high-intensity discharge lamp, for example, in a case where a discharge electrode has deteriorated. This problem is not limited to the high-intensity discharge lamp but is common in various kinds of discharge lamps that emit light by arc discharge between electrodes.

SUMMARY

An advantage of some aspects of the invention is to make a discharge lamp light more stably.

According to an aspect of the invention, a method for driving a discharge lamp that lights by performing discharge between two electrodes while alternately switching a polarity of a voltage applied between the two electrodes includes: modulating an anode duty ratio, which is a ratio of an anode time for which one of the electrodes operates as an anode in one period of the polarity switching, by setting first and second periods with different anode duty ratios; and setting the first period, in which the anode duty ratio is higher than that in the second period, longer than the second period in one modulation period, which includes the first and second periods and for which the modulation is performed, when a predetermined condition is satisfied.

According to the aspect of the invention, when the predetermined condition is satisfied, the first period with the higher anode duty ratio is set longer than the second period. In general, the temperature of the tip of the electrode at which discharge occurs rises by setting the anode duty ratio high. Accordingly, by setting the first period longer, the tip of the electrode melts to accelerate formation of a dome-like projection. The arc between the electrodes of the discharge lamp generally occurs from the projection formed as described above. Accordingly, since the arc occurrence position is stabilized, the discharge lamp lights more stably.

In the method for driving a discharge lamp described above, preferably, the one modulation period includes a third period in which the anode duty ratio is lower than that in the second period, and the third period is set longer than the second period in the one modulation period when the predetermined condition is satisfied.

In this case, in the third period, a duty ratio on an electrode side at which the anode duty ratio is set lower in the first period becomes higher than that in the second period. Accordingly, also in the electrode in which the anode duty ratio is set lower in the first period, formation of the dome-like projection is accelerated in the third period. As a result, it becomes easy to make the discharge lamp light more stably.

In the method for driving a discharge lamp described above, preferably, the discharge lamp has a condition in which an operating temperature of one of the two electrodes is higher than that of the other electrode, and an anode duty ratio in the one electrode is set to be lower than that in the other electrode.

In this case, the anode duty ratio in the one electrode whose operating temperature increases is set to be lower than that in the other electrode. Accordingly, since the excessive temperature increase in the electrode whose operating temperature increases is suppressed, deterioration of the electrode can be suppressed.

In this case, preferably, the discharge lamp has a reflecting mirror that reflects light emitted between the electrodes toward the other electrode side.

By providing the reflecting mirror, heat radiation from the electrode on a side at which the reflecting mirror is provided can be prevented. In this case, since the excessive temperature increase in the electrode, from which heat radiation is prevented as described above, is suppressed, deterioration of the electrode on the reflecting mirror side can be suppressed.

In the method for driving a discharge lamp described above, preferably, the predetermined condition is satisfied when a cumulative lighting time of the discharge lamp exceeds a predetermined reference time.

In this case, when the cumulative lighting time of the discharge lamp exceeds the reference time, the first period with the higher anode duty ratio is extended. Therefore, formation of a projection is accelerated for the electrode that has deteriorated due to the long cumulative lighting time, and an excessive temperature increase is suppressed for the electrode that has not deteriorated yet because the cumulative lighting time is short. As a result, deterioration of the electrodes can be suppressed and a decrease in the arc stability caused by the deterioration of the electrodes can also be suppressed.

In the method for driving a discharge lamp described above, it is preferable to further include: detecting a deterioration state of the electrode according to the use of the discharge lamp; and determining whether or not the predetermined condition is satisfied on the basis of the deterioration state.

In this case, the first period with the higher anode duty ratio is extended on the basis of the deterioration state of the electrode. Therefore, since formation of a projection is accelerated for the electrode that has deteriorated and an excessive temperature increase is suppressed for the electrode that has not deteriorated yet, deterioration of the electrodes can be suppressed and a decrease in the arc stability caused by the deterioration of the electrodes can also be suppressed.

In this case, preferably, the deterioration state is detected on the basis of a voltage applied between the two electrodes in supplying predetermined power between the two electrodes.

In general, when the electrode deteriorates, the arc length increases. As a result, a voltage applied in supplying the predetermined power rises. Therefore, according to the driving method described above, the deterioration state of the electrode can be detected more easily.

In the method for driving a discharge lamp described above, preferably, the period of the polarity switching is maintained as a constant value within one modulation period for which the modulation is performed.

In this case, the polar switching period is maintained as a constant value within the modulation period. Therefore, since the anode duty ratio can be modulated by a typical pulse width modulation circuit, it becomes easier to modulate the anode duty ratio.

In addition, the invention may also be realized in various forms. For example, the invention may be realized as a driving device for a discharge lamp, a light source device using a discharge lamp and a control method thereof, and an image display device using the light source device.

BRIEF DESCRIPTION OF THE DRAWINGS

The invention will be described with reference to the accompanying drawings, wherein like numbers reference like elements.

FIGS. 12A to 12D are explanatory views illustrating how a change in the anode duty ratio affects a discharge electrode.

DESCRIPTION OF EXEMPLARY EMBODIMENTS

Hereinafter, an embodiment of the invention will be described through examples in the following order.

A. First example
B. Second example
C. Modifications

A. First Example

Figure 1:
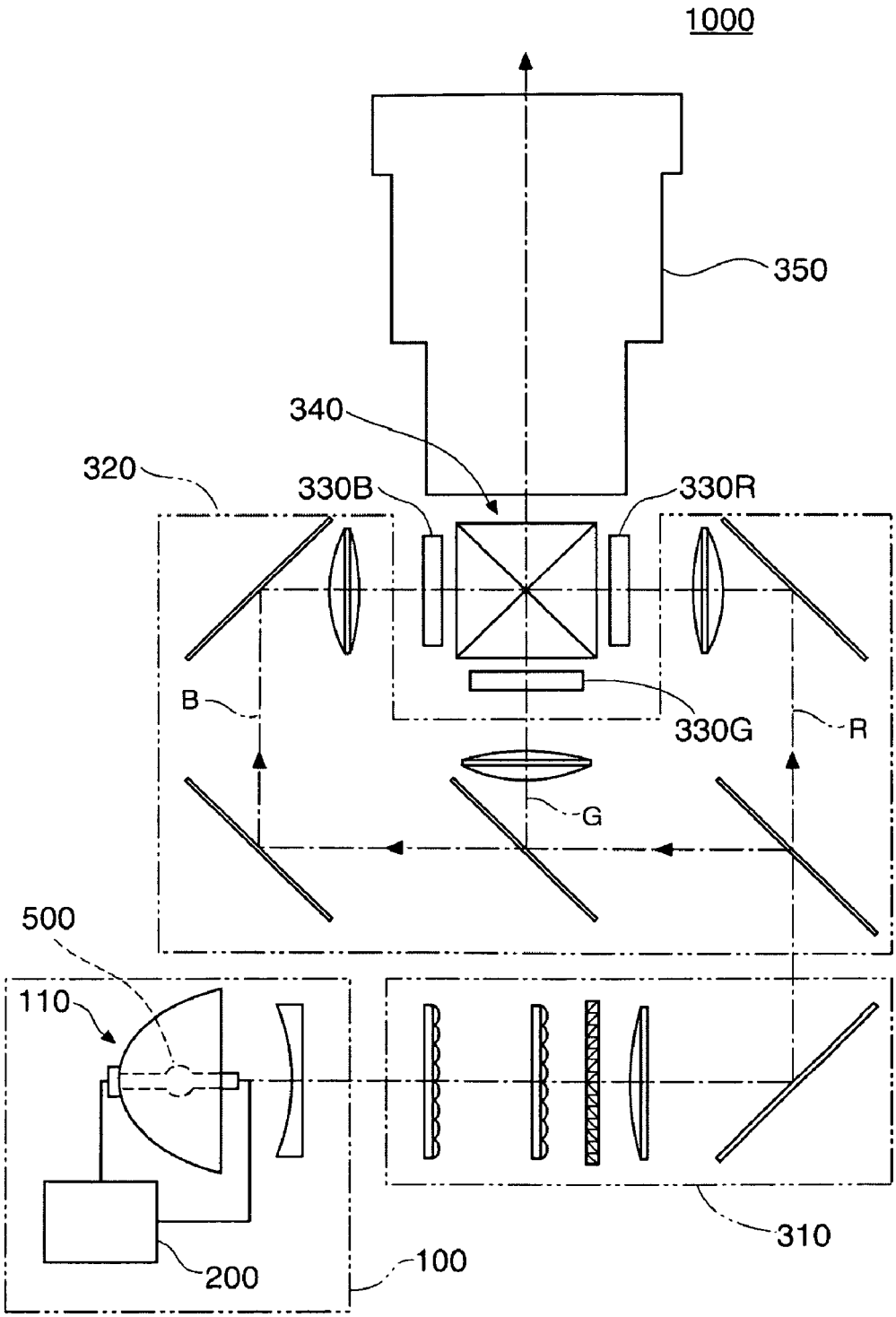
FIG. 1 is a schematic view illustrating the configuration of a projector in a first example of the invention.

FIG. 1 is a schematic view illustrating the configuration of a projector 1000 in a first example of the invention. The projector 1000 includes a light source device 100, an illumination optical system 310, a color separation optical system 320, three liquid crystal light valves 330R, 330G, and 330B, a cross dichroic prism 340, and a projection optical system 350.

The light source device 100 has a light source unit 110 to which a discharge lamp 500 is attached and a discharge lamp driving device 200 that drives the discharge lamp 500. The discharge lamp 500 receives power from the discharge lamp driving device 200 to emit light. The light source unit 110 emits discharged light of the discharge lamp 500 toward the illumination optical system 310. In addition, the specific configurations and functions of the light source unit 110 and discharge lamp driving device 200 will be described later.

The light emitted from the light source unit 110 has uniform illuminance by the illumination optical system 310, and the light emitted from the light source unit 110 is polarized in one direction by the illumination optical system 310. The light which has the uniform illuminance and is polarized in one direction through the illumination optical system 310 is separated into color light components with three colors of red (R), green (G), and blue (B) by the color separation optical system 320. The color light components with three colors separated by the color separation optical system 320 are modulated by the corresponding liquid crystal light valves 330R, 330G, and 330B, respectively. The color light components with three colors modulated by the liquid crystal light valves 330R, 330G, and 330B are mixed by the cross dichroic prism 340 to be then incident on the projection optical system 350. When the projection optical system 350 projects the incident light onto a screen (not shown), an image as a full color image in which images modulated by the liquid crystal light valves 330R, 330G, and 330B are mixed is displayed on the screen. In addition, although the color light components with the three colors are separately modulated by the three liquid crystal light valves 330R, 330G, and 330B in the first example, modulation of light may also be performed by one liquid crystal light valve provided with a color filter. In this case, the color separation optical system 320 and the cross dichroic prism 340 may be omitted.

Figure 2:
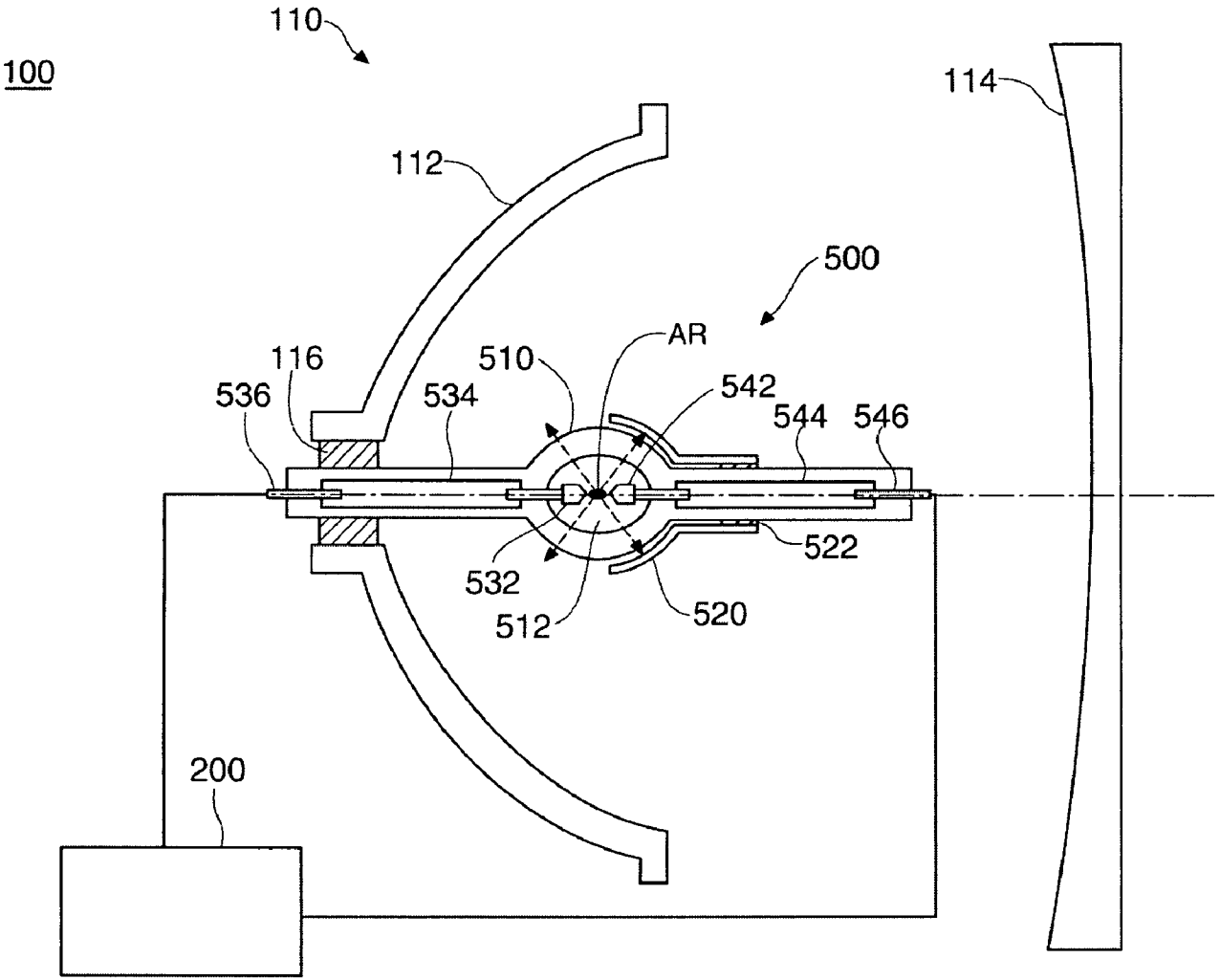
FIG. 2 is an explanatory view illustrating the configuration of a light source device.

FIG. 2 is an explanatory view illustrating the configuration of the light source device 100. The light source device 100 has the light source unit 110 and the discharge lamp driving device 200 as described above. The light source unit 110 includes the discharge lamp 500, a main reflecting mirror 112 having a spheroidal reflecting surface, and a parallelizing lens 114 that makes emitted light almost parallel light beams. However, the reflecting surface of the main reflecting mirror 112 does not necessarily need to be a spheroidal shape. For example, the reflecting surface of the main reflecting mirror 112 may have a paraboloidal shape. In this case, the parallelizing lens 114 may be omitted if a light emitting portion of the discharge lamp 500 is placed on a so-called focal point of a paraboloidal mirror. The main reflecting mirror 112 and the discharge lamp 500 are bonded to each other with an inorganic adhesive 116.

The discharge lamp 500 is formed by bonding a discharge lamp body 510 and an auxiliary reflecting mirror 520, which has a spherical reflecting surface, with an inorganic adhesive 522. The discharge lamp body 510 is formed of a glass material, such as quartz glass. Two discharge electrodes 532 and 542 formed of an electrode material using high-melting-point metal, such as tungsten, two connecting members 534 and 544, and two electrode terminals 536 and 546 are provided in the discharge lamp body 510. The discharge electrodes 532 and 542 are disposed such that tips thereof face each other in a discharge space 512 formed in the middle of the discharge lamp body 510. Rare gas or gas containing mercury or a metal halogen compound is injected as a discharge medium into the discharge space 512. The connecting member 534 is a member that electrically connects the discharge electrode 532 with the electrode terminal 536, and the connecting member 544 is a member that electrically connects the discharge electrode 542 with the electrode terminal 546.

The electrode terminals 536 and 546 of the discharge lamp 500 are connected to the discharge lamp driving device 200. The discharge lamp driving device 200 supplies a pulsed alternating current (AC pulse current) to the electrode terminals 536 and 546. When the AC pulse current is supplied to the electrode terminals 536 and 546, arc AR occurs between the tips of the two discharge electrodes 532 and 542 in the discharge space 512. The arc AR makes light emitted from the position, at which the arc AR has occurred, toward all directions. The auxiliary reflecting mirror 520 reflects light, which is emitted in a direction of one discharge electrode 542, toward the main reflecting mirror 112. The degree of parallelization of light emitted from the light source unit 110 can be further increased by reflecting the light emitted in the direction of the discharge electrode 542 toward the main reflecting mirror 112 as described above. Moreover, in the following description, the discharge electrode 542 on a side where the auxiliary reflecting mirror 520 is provided is also referred to as the 'auxiliary mirror side electrode 542', and the other discharge electrode 532 is also referred to as the 'main mirror side electrode 532'.

Figure 3:
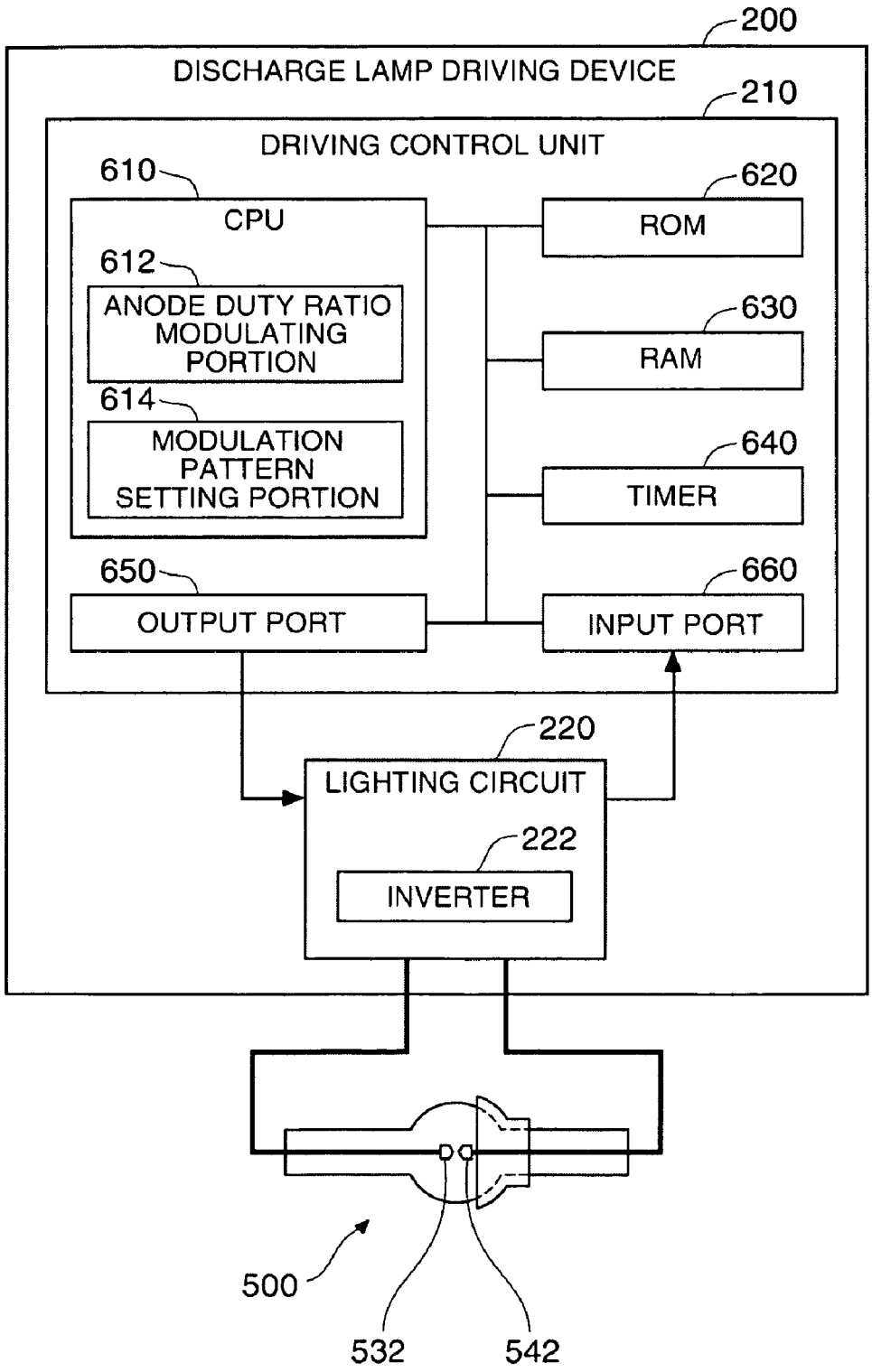
FIG. 3 is a block diagram illustrating the configuration of a discharge lamp driving device.

FIG. 3 is a block diagram illustrating the configuration of the discharge lamp driving device 200. The discharge lamp driving device 200 has a driving control unit 210 and a lighting circuit 220. The driving control unit 210 functions as a computer including a CPU 610, a ROM 620 and a RAM 630, a timer 640, an output port 650 for outputting a control signal to the lighting circuit 220, and an input port 660 for acquiring a signal from the lighting circuit 220. The CPU 610 of the driving control unit 210 executes a program stored in the ROM 620 on the basis of an output of the timer 640. Thus, the CPU 610 realizes a function of an anode duty ratio modulating portion 612 and a function of a modulation pattern setting portion 614. In addition, the functions of the anode duty ratio modulating portion 612 and modulation pattern setting portion 614 will be described later.

The lighting circuit 220 has an inverter 222 that generates an AC pulse current. The lighting circuit 220 supplies an AC pulse current with constant power (for example, 200 W) to the discharge lamp 500 by controlling the inverter 222 on the basis of a control signal supplied from the driving control unit 210 through the output port 650. Specifically, the lighting circuit 220 controls the inverter 222 to generate an AC pulse current corresponding to power supply conditions (for example, a frequency, a duty ratio, and a current waveform of the AC pulse current) designated by the control signal in the inverter 222. The lighting circuit 220 supplies the AC pulse current generated by the inverter 222 to the discharge lamp 500.

Figure 4:
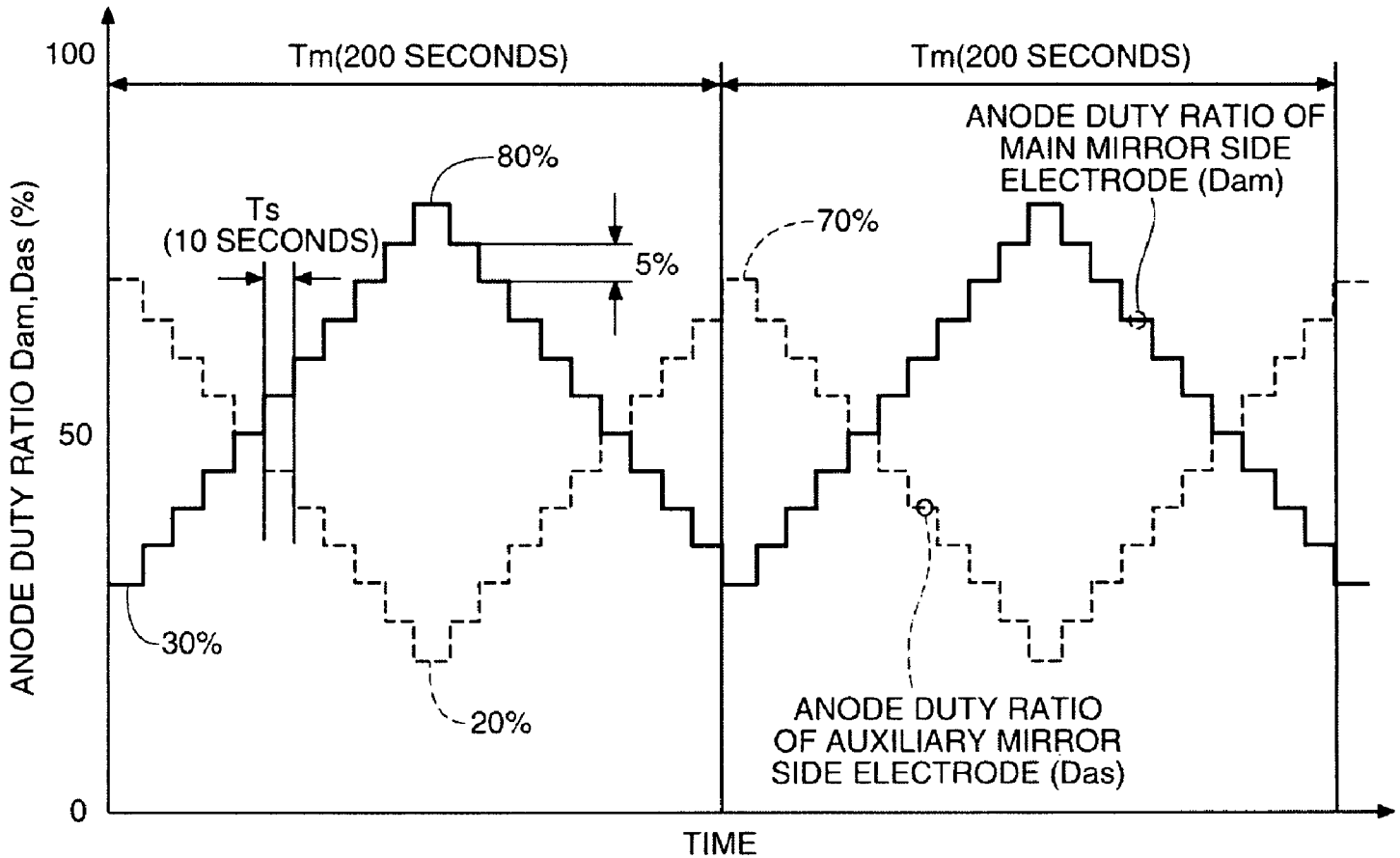
FIG. 4 is an explanatory view illustrating how a duty ratio of an AC pulse current is modulated.

The anode duty ratio modulating portion 612 of the driving control unit 210 modulates the duty ratio of the AC pulse current within a modulation period (for example, 200 seconds) set beforehand. FIG. 4 is an explanatory view illustrating a modulation pattern when the anode duty ratio modulating portion 612 modulates the duty ratio of an AC pulse current. The graph of FIG. 4 shows temporal changes of anode duty ratios Dam and Das. Here, the anode duty ratios Dam and Das are ratios of time (anode time), for which the two electrodes 532 and 542 operate as anodes, to one period of the AC pulse current, respectively. In the graph of FIG. 4, a solid line shows the anode duty ratio Dam of the main mirror side electrode 532, and a broken line shows the anode duty ratio Das of the auxiliary mirror side electrode 542.

In the example shown in FIG. 4, the anode duty ratio modulating portion 612 (FIG. 3) changes the anode duty ratios Dam and Das by a predetermined change width (5%) whenever a step time Ts (10 seconds) corresponding to 1/20 of a modulation period Tm (200 seconds) elapses. The anode duty ratio Dam of the main mirror side electrode 532 is modulated in a range of 30% to 80% and the anode duty ratio Das of the auxiliary mirror side electrode 542 is modulated in a range of 20% to 70%. Thus, by modulating the anode duty ratios Dam and Das within the modulation period Tm, uneven deposition of an electrode material on an inner wall of the discharge space 512 (FIG. 2) can be suppressed. By suppressing the uneven deposition of the electrode material, it becomes possible to suppress abnormal discharge caused by a variation in the amount of light of the discharge lamp 500 or growth of needle-like crystal of the electrode material. In addition, although the modulation period Tm is set to 200 seconds in the first example, the modulation period Tm may be suitably changed on the basis of a characteristic, a power supply condition, and the like of the discharge lamp 500.

In the modulation pattern shown in FIG. 4, the step time Ts is a fixed period (10 seconds) during the whole modulation period Tm. That is, the time for which each of the anode duty ratios Dam and Das is maintained as a constant value is constant regardless of values of the anode duty ratios Dam and Das. However, as will be described later, when a modulation pattern is changed by the modulation pattern setting portion 614, the step time Ts increases or decreases separately for the respective values of the set anode duty ratios Dam and Das, resulting in different lengths within the modulation period Tm.

As is apparent from FIG. 4, in the first example, a maximum value (80%) of the anode duty ratio Dam of the main mirror side electrode 532 is set to be higher than a maximum value (70%) of the anode duty ratio Das of the auxiliary mirror side electrode 542. However, the maximum values of the anode duty ratios of the two discharge electrodes 532 and 542 do not necessarily need to be different. However, when the maximum values of the anode duty ratios are made high, the highest temperatures of the discharge electrodes 532 and 542 are increased as will be described later. On the other hand, when the discharge lamp 500 having the auxiliary reflecting mirror 520 is used as shown in FIG. 2, the heat from the auxiliary mirror side electrode 542 becomes difficult to be emitted. Therefore, it is more preferable to set the maximum value of the anode duty ratio Dam of the main mirror side electrode 532 higher than that of the anode duty ratio Das of the auxiliary mirror side electrode 542 from a point of view that an excessive temperature increase in the auxiliary mirror side electrode 542 can be suppressed. Moreover, in general, when the temperature of one of the discharge electrodes 532 and 534 becomes higher than that of the other one due to an influence of a cooling method or the like in driving the two discharge electrodes 532 and 542 in the same operating condition, it is more preferable to make the anode duty ratio of the one discharge electrode lower than that of the other one.

Furthermore, in the first example, the anode duty ratio Dam of the main mirror side electrode 532 increases for every step time Ts in the first half of the modulation period Tm and decreases for every step time Ts in the second half. However, the change pattern of the anode duty ratios Dam and Das is not necessarily limited thereto. For example, the anode duty ratio Dam of the main mirror side electrode 532 may be made to monotonically increase or monotonically decrease within the modulation period Tm. However, it is more preferable to make the amount of change in the anode duty ratios Dam and Das for every step time Ts constant as shown in FIG. 4 from a point of view that the thermal shock applied to the discharge lamp 500 can be reduced.

Figure 5A:
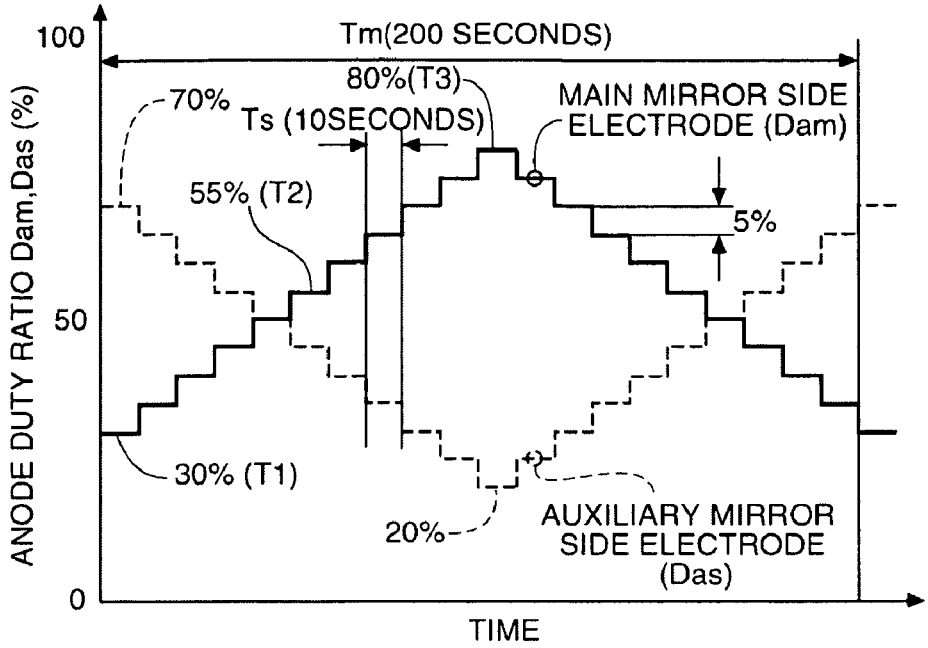
FIGS. 5A and 5B are explanatory views illustrating how the anode duty ratio is modulated to drive a discharge lamp.
Figure 5B:
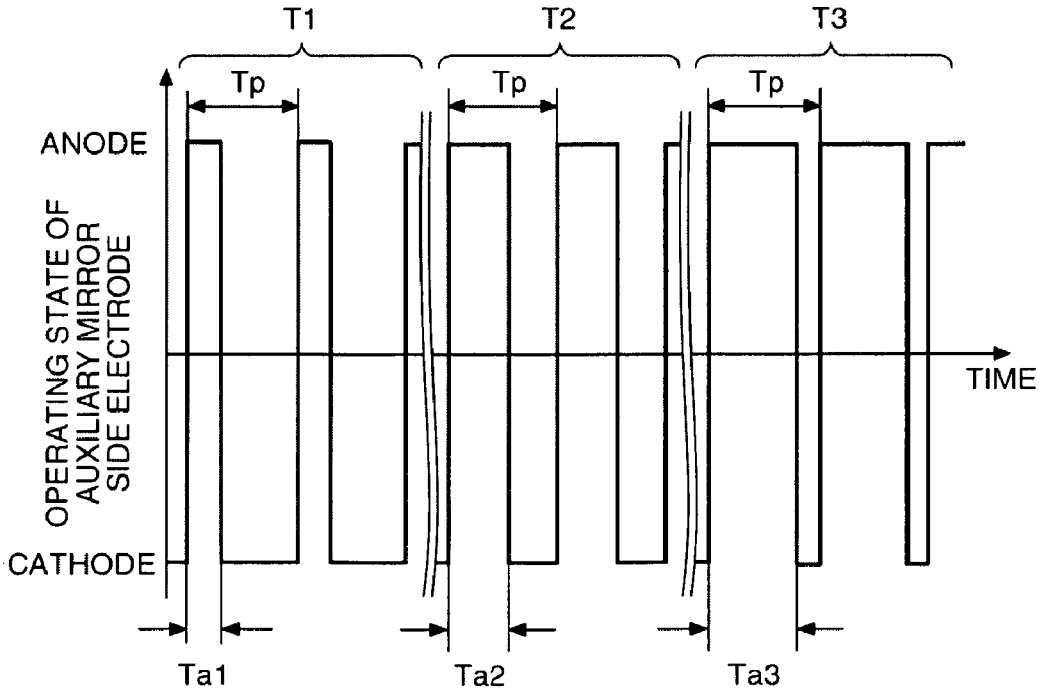

FIGS. 5A and 5B are explanatory views illustrating how the anode duty ratios Dam and Das are modulated to drive the discharge lamp 500. FIG. 5A is different from FIG. 4 in that temporal changes in the anode duty ratios Dam and Das are shown for only one modulation period (1 Tm). Since the other points are almost similar to those described in FIG. 4, an explanation thereof will be omitted. FIG. 5B is a graph illustrating a temporal change of an operating state of the main mirror side electrode 532 in three periods T1 to T3 in which the anode duty ratio Dam of the main mirror side electrode 532 in FIG. 5A is set to different values (30%, 55%, and 80%)).

As shown in FIG. 5B, in all of the three periods T1 to T3 with the different anode duty ratios Dam, the switching period Tp in which the polarity of the main mirror side electrode 532 is switched is constant. Thus, in the first example, a frequency (f=1/Tp) of the AC pulse current is set to a fixed frequency (for example, 80 Hz) over the whole period of the modulation period Tm. On the other hand, anode times Ta1 to Ta3 of the main mirror side electrode 532 are set to different values in the periods T1 to T3 with the different anode duty ratios Dam. Thus, in the first example, modulation of the anode duty ratio Dam is performed by changing the anode time Ta while keeping the frequency f of the AC pulse current constant. In addition, the frequency f of the AC pulse current does not necessarily need to be constant. However, it is more preferable to make the frequency f of the AC pulse current constant from a point of view that the anode duty ratio Dam can be modulated using a typical pulse width modulation circuit.

In the first example, the modulation pattern setting portion 614 (FIG. 3) of the driving control unit 210 changes a modulation pattern of the anode duty ratio, which is set within the modulation period Tm, on the basis of a deterioration state of the discharge lamp 500. Specifically, the CPU 610 acquires, through the input port 660, a lamp voltage as a parameter indicating the deterioration state of the discharge lamp 500. Here, the lamp voltage refers to a voltage between the discharge electrodes 532 and 542 when driving the discharge lamp 500 with constant power. The modulation pattern setting portion 614 sets a modulation pattern of the duty ratio in the anode duty ratio modulating portion 612 on the basis of the lamp voltage (detection lamp voltage) acquired as described above. The anode duty ratio modulating portion 612 controls the lighting circuit 220 such that the anode duty ratio is changed according to the modulation pattern set by the modulation pattern setting portion 614. In addition, a method of setting a modulation pattern of the anode duty ratio using the modulation pattern setting portion 614 will be described later.

Figure 6A:
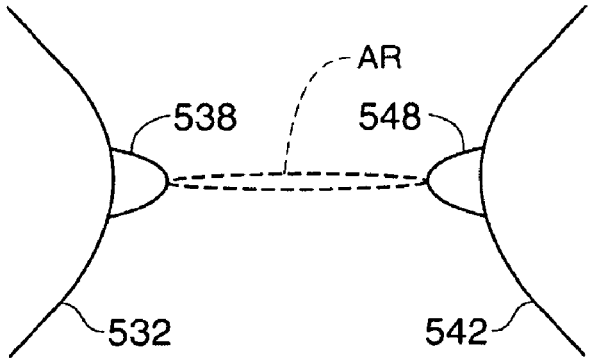
FIGS. 6A and 6B are explanatory views illustrating how a deterioration state of a discharge lamp is detected by a lamp voltage.
Figure 6B:
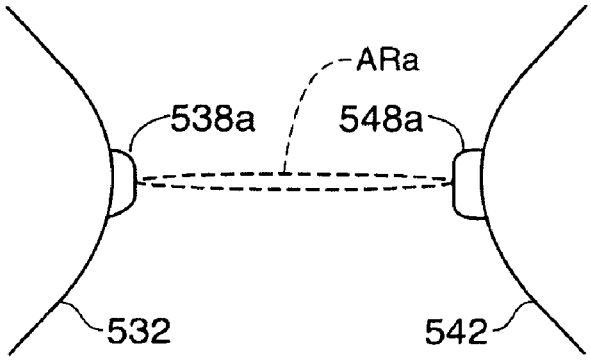

FIGS. 6A and 6B are explanatory views illustrating how the deterioration state of the discharge lamp 500 is detected by the lamp voltage. FIG. 6A illustrates the shapes of tips of the discharge electrodes 532 and 542 in an initial state. FIG. 6B illustrates the shapes of the tips of the discharge electrodes 532 and 542 in a state where the discharge lamp 500 has deteriorated. As shown in FIG. 6A, in the initial state, dome-like projections 538 and 548 are formed on the tips of the discharge electrodes 532 and 542 so as to protrude toward the opposite discharge electrodes, respectively.

In this case, the arc AR caused by discharge between the discharge electrodes 532 and 542 occurs between the two projections 538 and 548. As the discharge lamp 500 is used, electrode materials evaporate from the projections 538 and 548 and the tips of projections 538*a* and 548*a* become flat as shown in FIG. 6B. When the tips of the projections 538*a* and 548*a* become flat, the length of discharge arc ARa increases. As a result, a voltage between electrodes required to supply the same power, that is, a lamp voltage, rises. Thus, the lamp voltage rises gradually as the discharge lamp 500 deteriorates. Therefore, in the first example, the lamp voltage is used as a parameter indicating the deterioration state of the discharge lamp 500.

Figure 7:
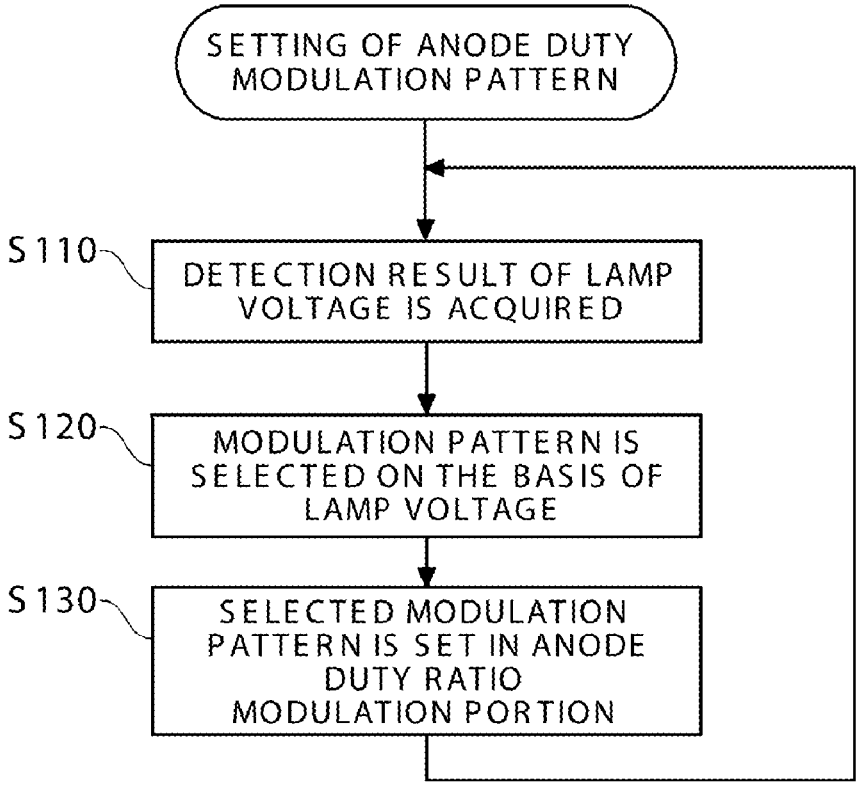
FIG. 7 is a flow chart illustrating the flow of processing when a modulation pattern setting portion determines a modulation range.

FIG. 7 is a flow chart illustrating the flow of processing when the modulation pattern setting portion 614 sets a modulation pattern of the anode duty ratio. This processing is always executed in the discharge lamp driving device 200 when the projector 1000 starts or while the discharge lamp 500 is lighting. However, the processing for setting the modulation pattern does not necessarily need to be executed all the time. For example, the processing for setting the modulation pattern may also be executed when the CPU 610 receives an interval signal by configuring the timer 640 (FIG. 3) to generate the interval signal whenever a predetermined lighting time (for example, 10 hours) of the discharge lamp 500 elapses.

In step S110, the modulation pattern setting portion 614 acquires a lamp voltage that the CPU 610 has acquired through the input port 660. Then, in step S120, the modulation pattern setting portion 614 selects a modulation pattern on the basis of the acquired lamp voltage. Specifically, the modulation pattern setting portion 614 selects a modulation pattern with reference to data that is stored in the ROM 620 or the RAM 630 and matches a range of a lamp voltage with a modulation pattern. In step S130, the modulation pattern setting portion 614 sets the selected modulation pattern in the anode duty ratio modulating portion 612. Then, the anode duty ratio is modulated in the pattern set according to the lamp voltage. After step S130, the control returns to step S110 and the processing of steps S110 to S130 is repeatedly executed.

FIGS. 8 to 11 illustrate an example of a modulation pattern set on the basis of a lamp voltage Vp. In the example shown in FIGS. 8 to 11, a lamp voltage (initial lamp voltage) in an initial state of the discharge lamp 500 is set to about 65V. When the lamp voltage Vp rises gradually with the use of the discharge lamp 500, the modulation pattern changes from a first period modulation pattern shown in FIG. 8 sequentially to a second period modulation pattern shown in FIG. 9, a third period modulation pattern shown in FIG. 10, and a fourth period modulation pattern shown in FIG. 11.

Figure 8:
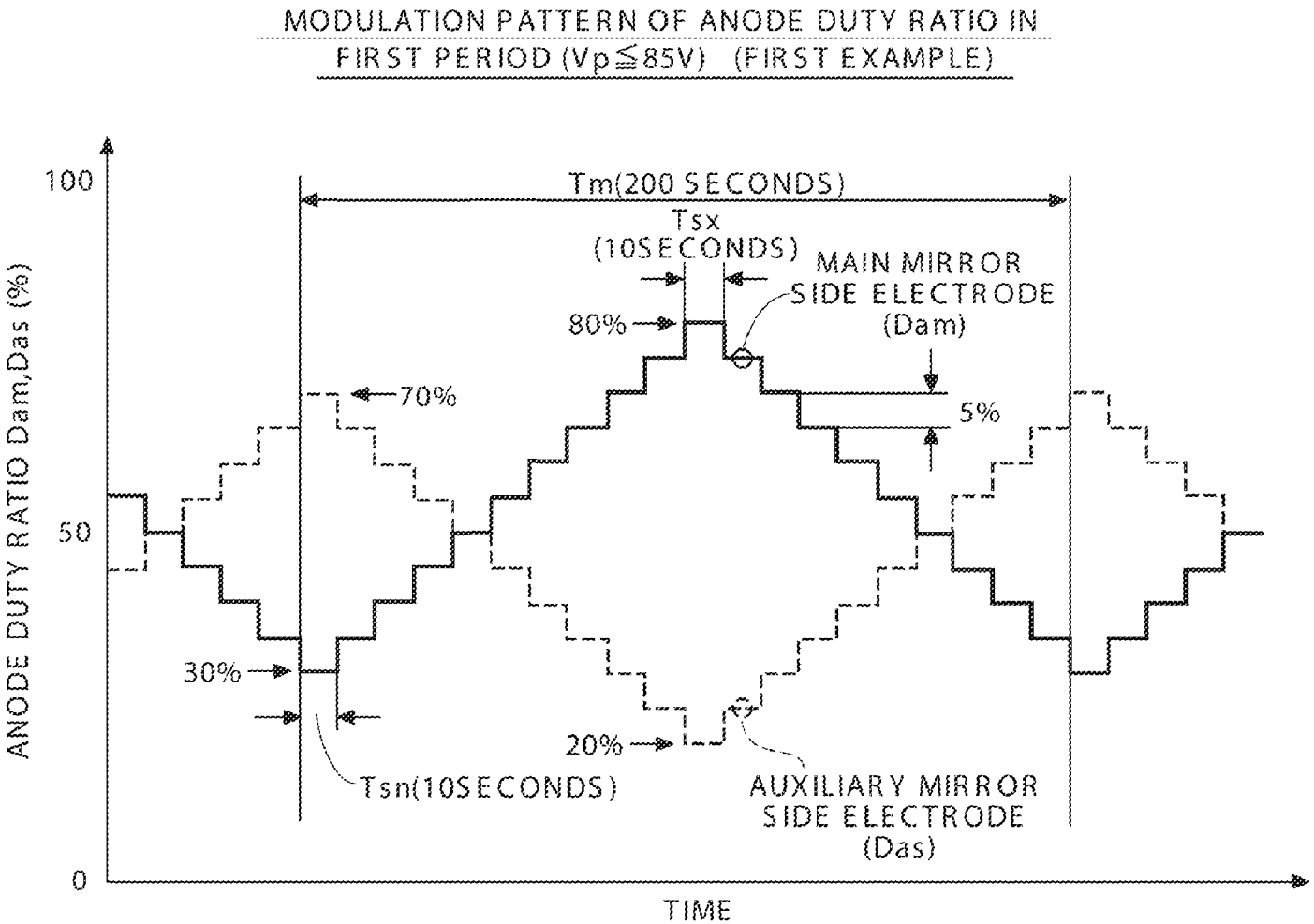
FIG. 8 is an explanatory view illustrating an example of a modulation pattern of the anode duty ratio in a first period.

FIG. 8 illustrates a modulation pattern in a first period until the lamp voltage Vp reaches 85 V from an initial lamp voltage (about 65 V). FIG. 8 is almost the same as FIG. 5A. In the first period, both a highest duty ratio time Tsx and a lowest duty ratio time Tsn are set to 10 seconds. In addition, a time interval in which the anode duty ratios Dam and Das are changed is also set to a fixed time (10 seconds) during the modulation period Tm.

Figure 9:
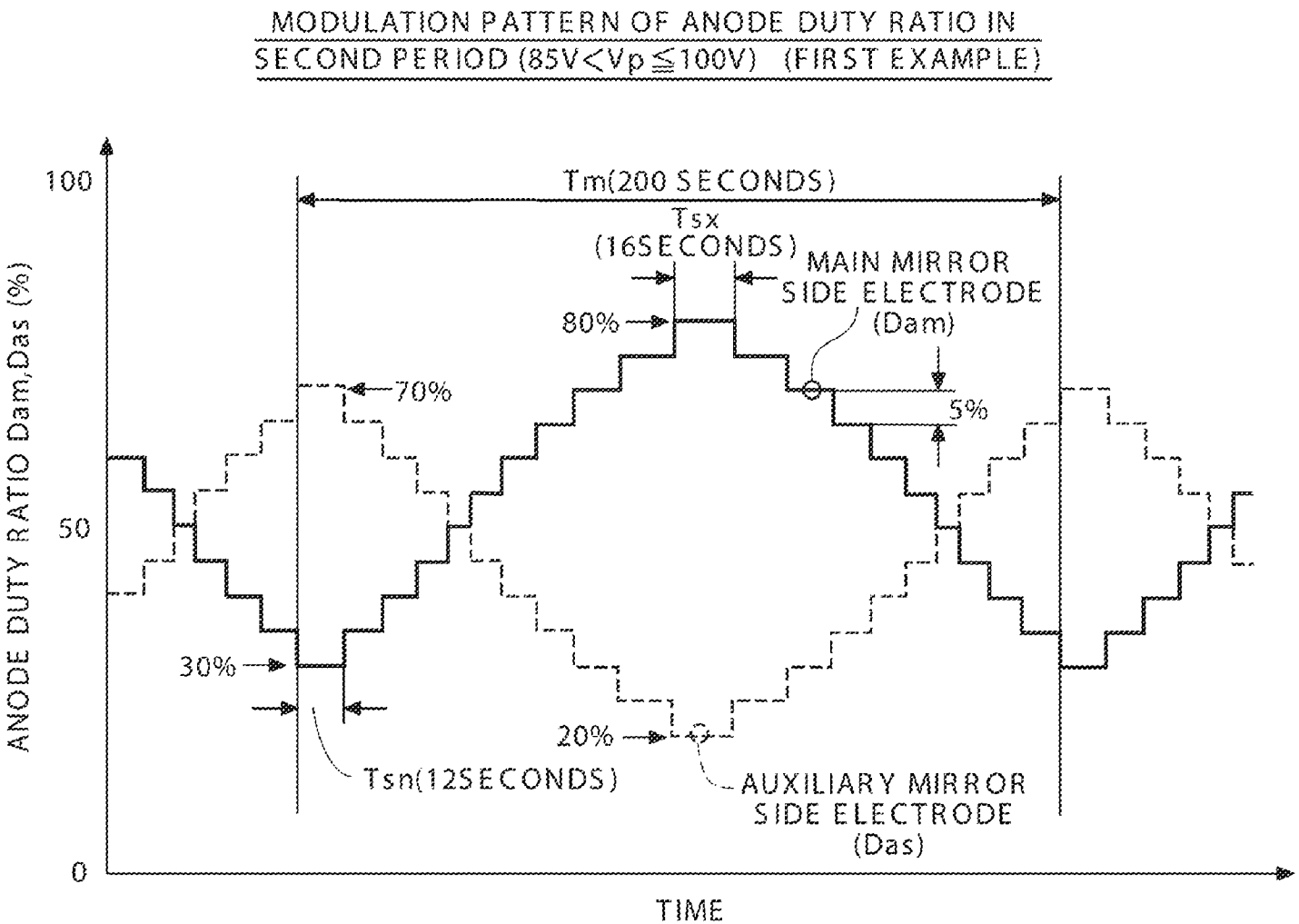
FIG. 9 is an explanatory view illustrating an example of a modulation pattern of the anode duty ratio in a second period.

FIG. 9 illustrates a modulation pattern in a second period until the lamp voltage Vp reaches 100 V after exceeding 85V. In the second period, the highest duty ratio time Tsx is set to 16 seconds and the lowest duty ratio time Tsn is set to 12 seconds. Also in the second period, the number of times (20 times) of change of the anode duty ratios Dam and Das in the modulation period Tm and the change widths (5%) of the anode duty ratios Dam and Das for every change are the same as those in the first period. Therefore, the modulation range (30% to 80%) of the anode duty ratio Dam of the main mirror side electrode 532 in the second period is the same as that of the anode duty ratio Dam of the main mirror side electrode 532 in the first period.

Figure 10:
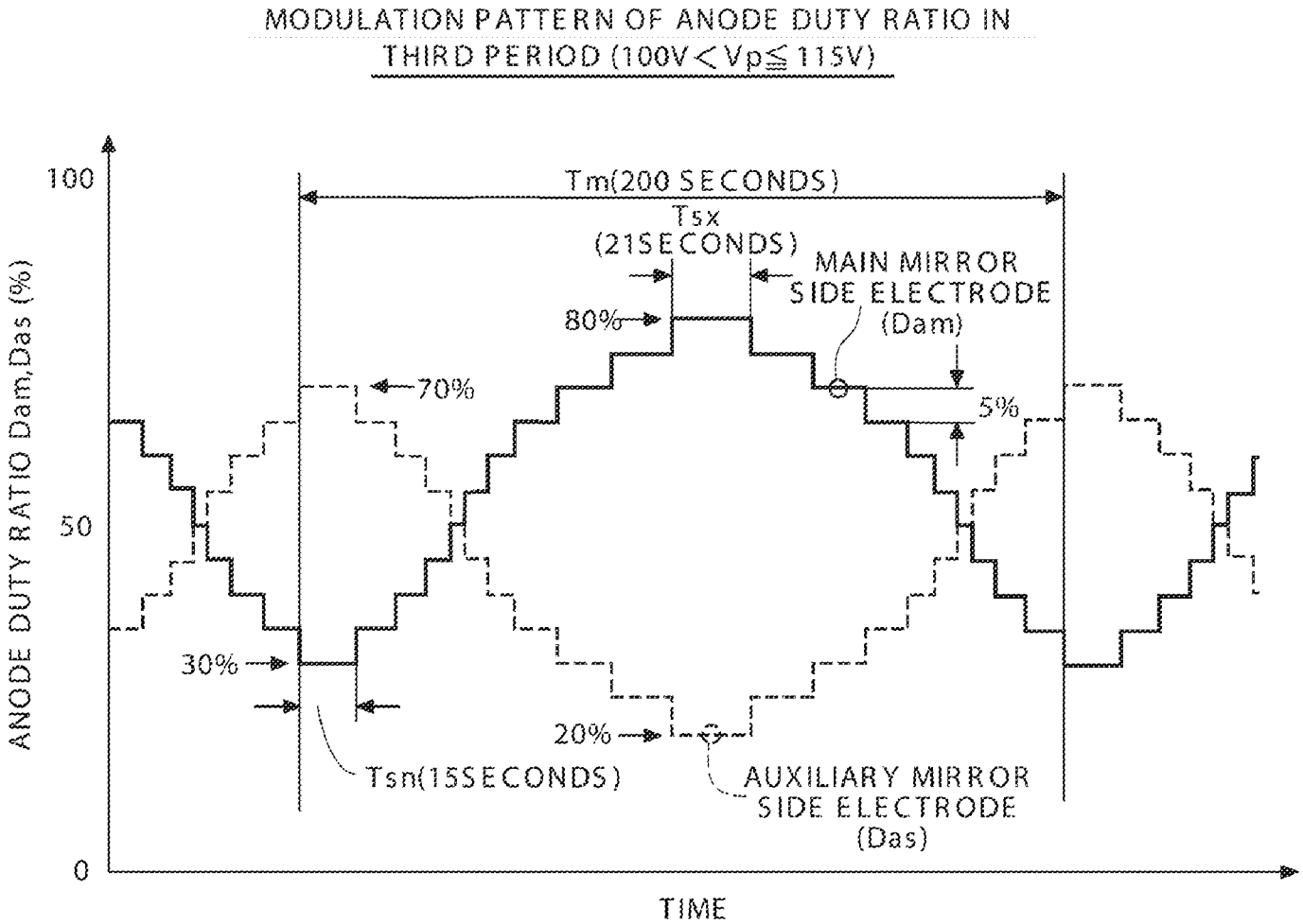
FIG. 10 is an explanatory view illustrating an example of a modulation pattern of the anode duty ratio in a third period.

FIG. 10 illustrates a modulation pattern in a third period until the lamp voltage Vp reaches 115 V after exceeding 100V. In the third period, the highest duty ratio time Tsx is set to 21 seconds and the lowest duty ratio time Tsn is set to 15 seconds. Also in the third period, the number of times (20 times) of change of the anode duty ratios Dam and Das in the modulation period Tm and the change widths (5%) of the anode duty ratios Dam and Das for every change are the same as those in the first period. Therefore, the modulation range (30% to 80%) of the anode duty ratio Dam of the main mirror side electrode 532 in the third period is the same as that of the anode duty ratio Dam of the main mirror side electrode 532 in the first period.

Figure 11:
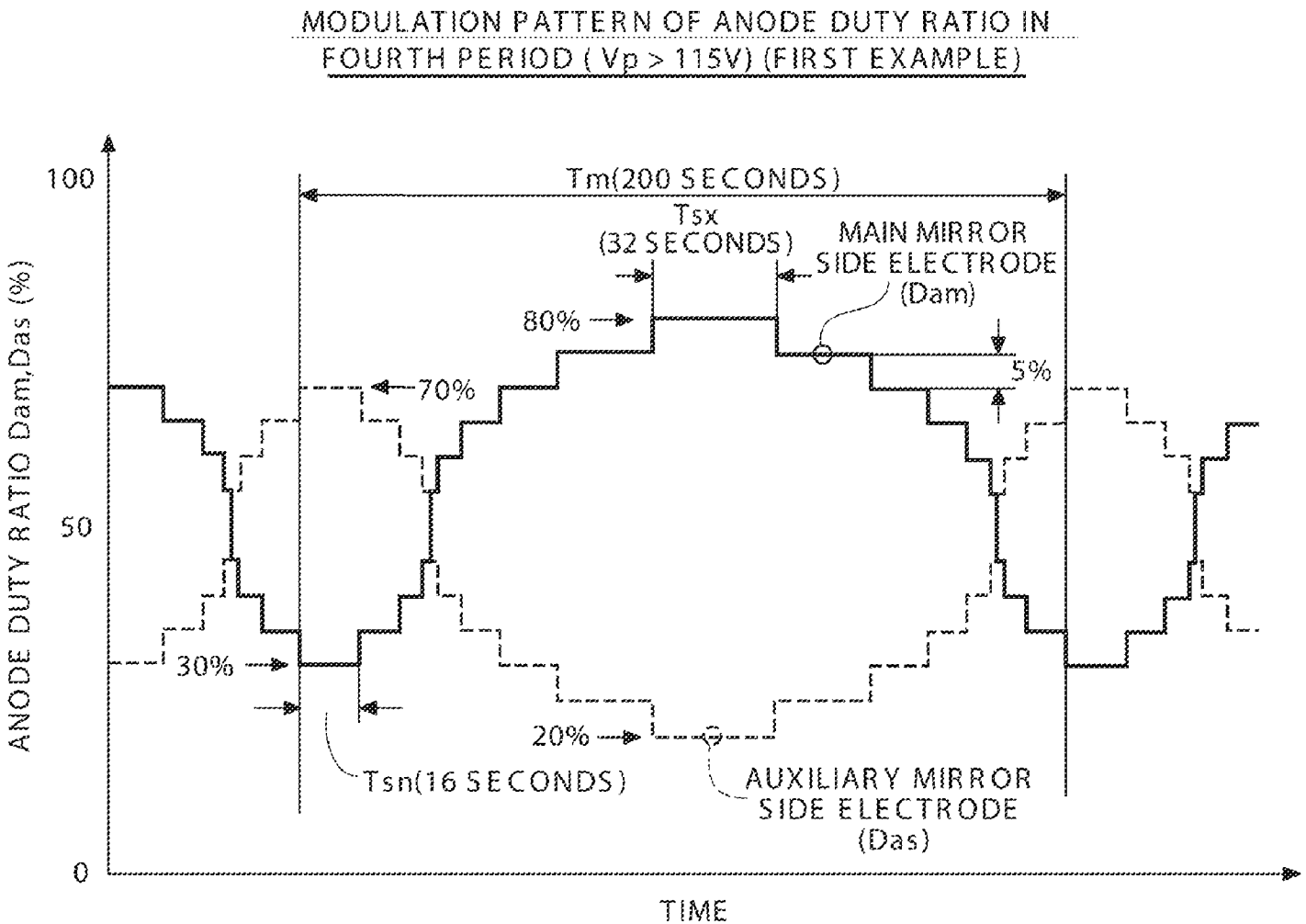
FIG. 11 is an explanatory view illustrating an example of a modulation pattern of the anode duty ratio in a fourth period.
Figure 13:
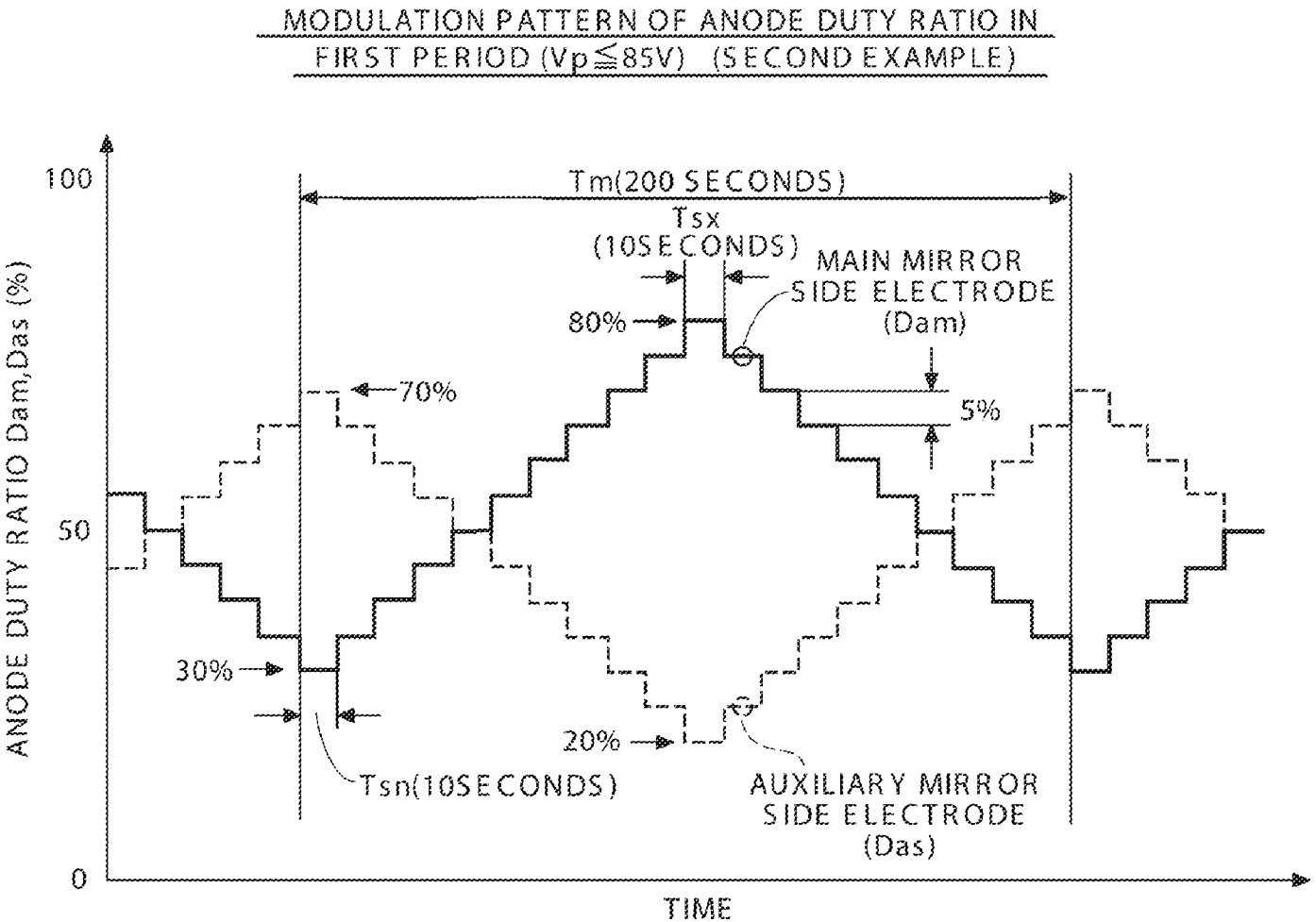
FIG. 13 is an explanatory view illustrating a modulation pattern in a first period in the second example.

FIG. 11 illustrates a modulation pattern in a fourth period in which the lamp voltage Vp exceeds 115 V. In the fourth period, the highest duty ratio time Tsx is set to 32 seconds and the lowest duty ratio time Tsn is set to 16 seconds. Also in the fourth period, the number of times (20 times) of change of the anode duty ratios Dam and Das in the modulation period Tm and the change widths (5%) of the anode duty ratios Dam and Das for every change are the same as those in the first period. Therefore, the modulation range (30% to 80%) of the anode duty ratio Dam of the main mirror side electrode 532 in the fourth period is the same as that of the anode duty ratio Dam of the main mirror side electrode 532 in the first period.

FIGS. 12A to 12D are explanatory views illustrating how an increase in the anode duty ratio affects the discharge electrode. FIGS. 12A and 12B illustrate the appearance of the main mirror side electrode 532 in a state where the main mirror side electrode 532 operates as an anode. FIG. 12C is a graph illustrating a temporal change of an operating state of the main mirror side electrode 532. FIG. 12D is a graph illustrating a temporal change of the temperature of the main mirror side electrode 532.

As shown in FIGS. 12A and 12B, when the main mirror side electrode 532 operates as an anode, electrons are emitted from the auxiliary mirror side electrode 542 to collide with the main mirror side electrode 532. By the collision of electrons, the kinetic energy of electrons is converted into the heat energy in the main mirror side electrode 532 on the anode side. As a result, the temperature of the main mirror side electrode 532 rises. On the other hand, since the collision of electrons does not occur in the auxiliary mirror side electrode 542 on the cathode side, the temperature of the auxiliary mirror side electrode 542 decreases due to heat conduction, emission, and the like. Similarly, in a period for which the main mirror side electrode 532 operates as a cathode, the temperature of the main mirror side electrode 532 falls and the temperature of the auxiliary mirror side electrode 542 rises.

Accordingly, if the anode duty ratio of the main mirror side electrode 532 is made high as shown in FIG. 12C, a period for which the temperature of the main mirror side electrode 532 rises becomes long and a period for which the temperature of the main mirror side electrode 532 falls becomes short as shown in FIG. 12D. By setting the anode duty ratio of the main mirror side electrode 532 high as described above, the highest temperature of the main mirror side electrode 532 is increased. When the highest temperature of the main mirror side electrode 532 is increased, a melted portion MR formed by melting of the electrode material is generated at the tip of a projection 538*b* as shown in FIG. 12B. The melted portion MR formed by melting of the electrode material has a dome shape due to the surface tension. Therefore, as shown in FIG. 12A, the dome-like projection 538*b* is formed again from the projection 538*a* with a flat tip.

In the first example, as shown in FIGS. 8 to 11, the highest duty ratio time Tsx for which the anode duty ratio Dam of the main mirror side electrode 532 is a maximum value is set to be longer than that in the first period as the lamp voltage Vp rises. Thus, a state where the temperature of the main mirror side electrode 532 rises is maintained for a longer period of time by setting the highest duty ratio time Tsx in the second to fourth periods, in which the lamp voltage Vp has risen, longer than that in the initial first period. By maintaining the state where the temperature of the main mirror side electrode 532 rises, the dome-like projection 538*b* of the main mirror side electrode 532 is reliably formed again. In addition, the modulation pattern setting portion 614 extends the highest duty ratio time Tsx by changing the modulation pattern as described above. For this reason, the modulation pattern setting portion 614 may also be referred to as a 'high duty period extending portion' that extends a period for which the anode duty ratio is higher.

On the other hand, the lowest duty ratio time Tsn for which the anode duty ratio is a minimum value, that is, the amount of change in time taken for the anode duty ratio Das of the second discharge electrode 542 to reach the maximum value is smaller than the amount of change in the highest duty ratio time Tsx. Accordingly, in the second to fourth periods, the time taken for the anode duty ratio Das of the second discharge electrode 542 to reach the maximum value is shorter than the time taken for the anode duty ratio Dam of the first discharge electrode 532 to reach the maximum value. As a result, also in the second to fourth periods, an excessive temperature increase in the auxiliary mirror side electrode 542 can be suppressed. Also in this case, the temperature of the auxiliary mirror side electrode 542, from which heat radiation is prevented by the auxiliary reflecting mirror 520, generally rises sufficiently. Accordingly, the dome-like projection is also formed again in the auxiliary mirror side electrode 542.

In the first example, as shown in FIG. 6B, when the tips of the projections 538*a* and 548*a* become flat to cause the lamp voltage to rise, the time taken for the anode duty ratio Dam of the discharge electrode 532 to be set to the maximum value becomes longer, which accelerates re-formation of the dome-like projection 538*b*. Thus, since the tips of the projections 538 and 548 are made flat, occurrence of the problem (arc jump) that the position of arc moves during lighting due to unstable arc occurrence position is suppressed.

Thus, in the first example, the modulation patterns of the anode duty ratios Dam and Das of the two discharge electrodes 532 and 542 change as the lamp voltage rises. The modulation pattern is set such that the time for which the anode duty ratio Dam of the main mirror side electrode 532 is set to the maximum value becomes long as the lamp voltage Vp rises. Accordingly, re-formation of a projection is accelerated for the discharge lamp 500 that has deteriorated, and the progress of deterioration caused by an excessive temperature increase in the discharge electrodes 532 and 542 is suppressed for the discharge lamp 500 that has not deteriorated yet. As a result, it becomes easy to make the discharge lamp 500 light stably over a longer period of time.

In addition, a modulation pattern, such as the number of times of change or the change width of each of the anode duty ratios Dam and Das in the modulation period Tm, and a lamp voltage for changing the modulation pattern may be suitably set according to the characteristics of a discharge lamp, such as the type of the discharge lamp or the shape of a discharge electrode. For example, it is preferable that the change of the anode duty ratios Dam and Das be performed at least once in the modulation period Tm. Also in this case, re-formation of projections of the discharge electrodes 532 and 542 are accelerated by making the time, for which the anode duty ratio Dam of the main mirror side electrode 532 is set higher, longer than the time for which the anode duty ratio Dam of the main mirror side electrode 532 is set lower. Moreover, when the change of the anode duty ratios Dam and Das is performed twice or more, the period that becomes long corresponding to the lamp voltage Vp may not necessarily be a period for which the anode duty ratio Dam is set to the maximum value.

B. Second Example

FIGS. 13 to 16 illustrate an example of a modulation pattern set on the basis of a lamp voltage Vp in the second example. In the second example, modulation patterns (FIGS. 14 to 16) in second and third periods shown in FIGS. 13 to 16 are different from the modulation patterns (FIGS. 9 to 11) in the first example. Since the other points are almost similar to those in the first example, an explanation thereof will be omitted.

Figure 14:
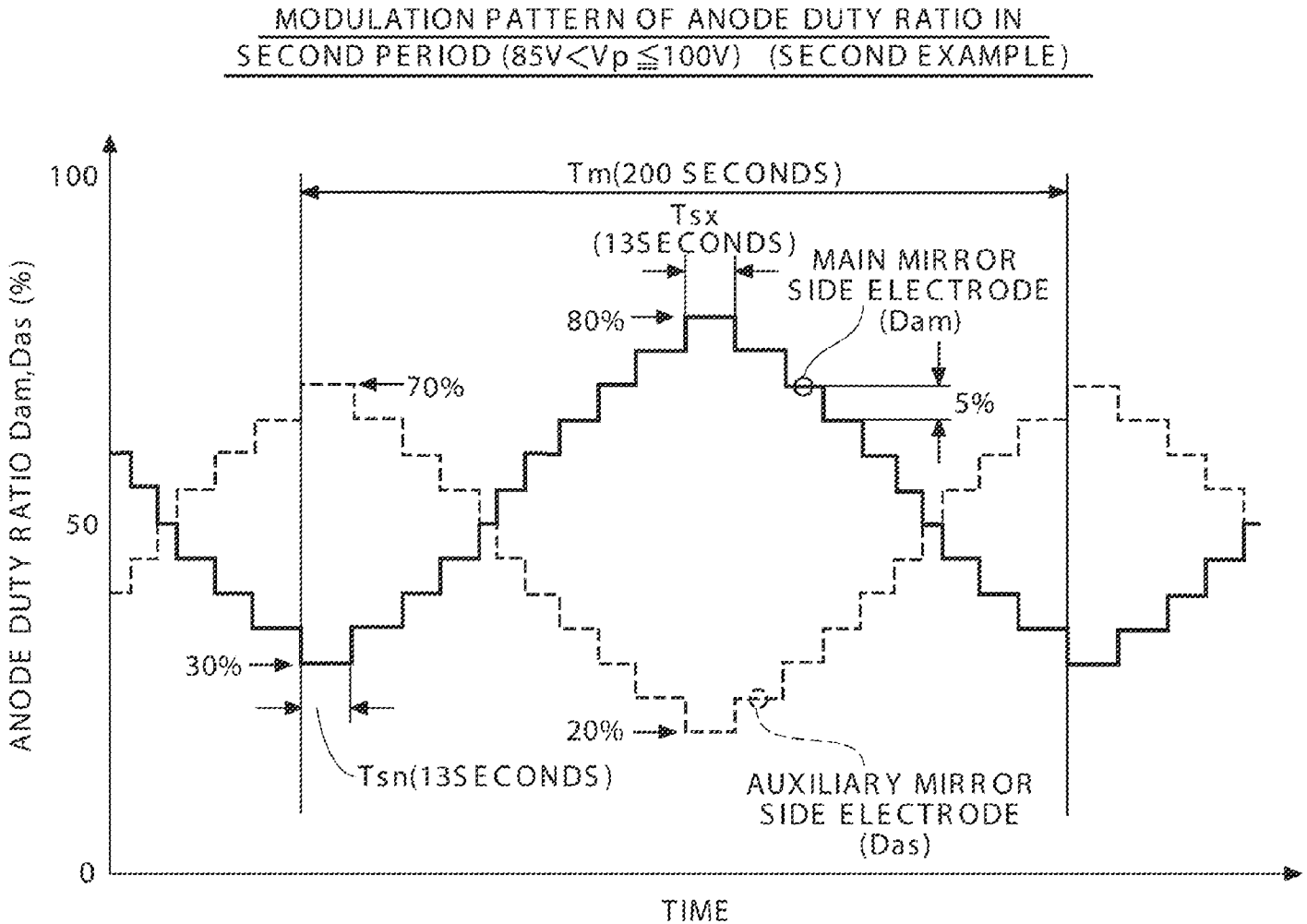
FIG. 14 is an explanatory view illustrating a modulation pattern in a second period in the second example.

FIG. 14 illustrates a modulation pattern in the second period until the lamp voltage Vp reaches 100 V after exceeding 85 V. In the second period, both the highest duty ratio time Tsx and the lowest duty ratio time Tsn are set to 13 seconds. Also in the second period, the number of times (20 times) of change of the anode duty ratios Dam and Das in the modulation period Tm and the change widths (5%) of the anode duty ratios Dam and Das for every change are the same as those in the first period. Therefore, the modulation range (30% to 80%) of the anode duty ratio Dam of the main mirror side electrode 532 in the second period is the same as that of the anode duty ratio Dam of the main mirror side electrode 532 in the first period.

Figure 15:
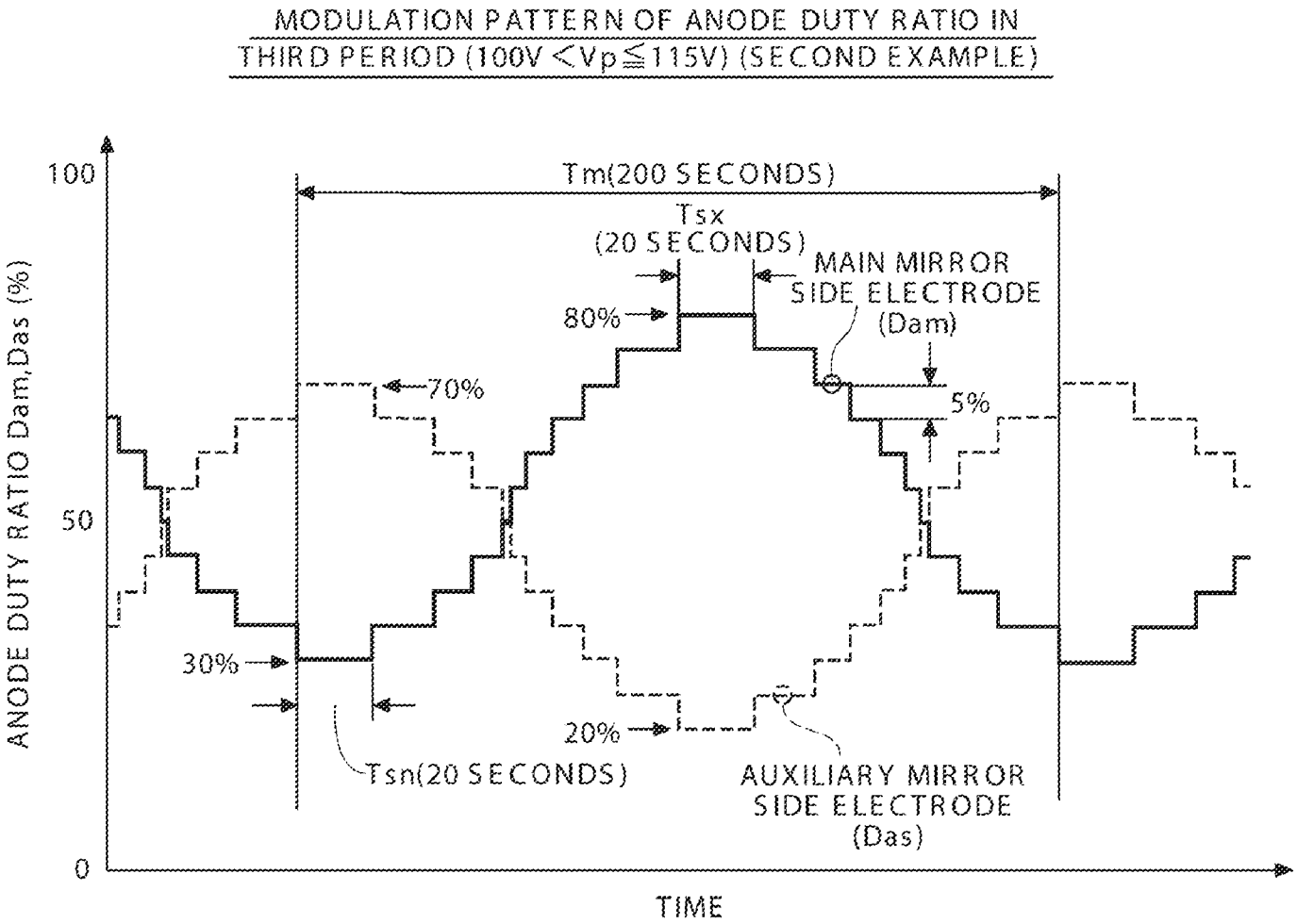
FIG. 15 is an explanatory view illustrating a modulation pattern in a third period in the second example.

FIG. 15 illustrates a modulation pattern in the third period until the lamp voltage Vp reaches 115 V after exceeding 100V. In the third period, both the highest duty ratio time Tsx and the lowest duty ratio time Tsn are set to 20 seconds. Also in the third period, the number of times (20 times) of change of the anode duty ratios Dam and Das in the modulation period Tm and the change widths (5%) of the anode duty ratios Dam and Das for every change are the same as those in the first period. Therefore, the modulation range (30% to 80%) of the anode duty ratio Dam of the main mirror side electrode 532 in the third period is the same as that of the anode duty ratio Dam of the main mirror side electrode 532 in the first period.

Figure 16:
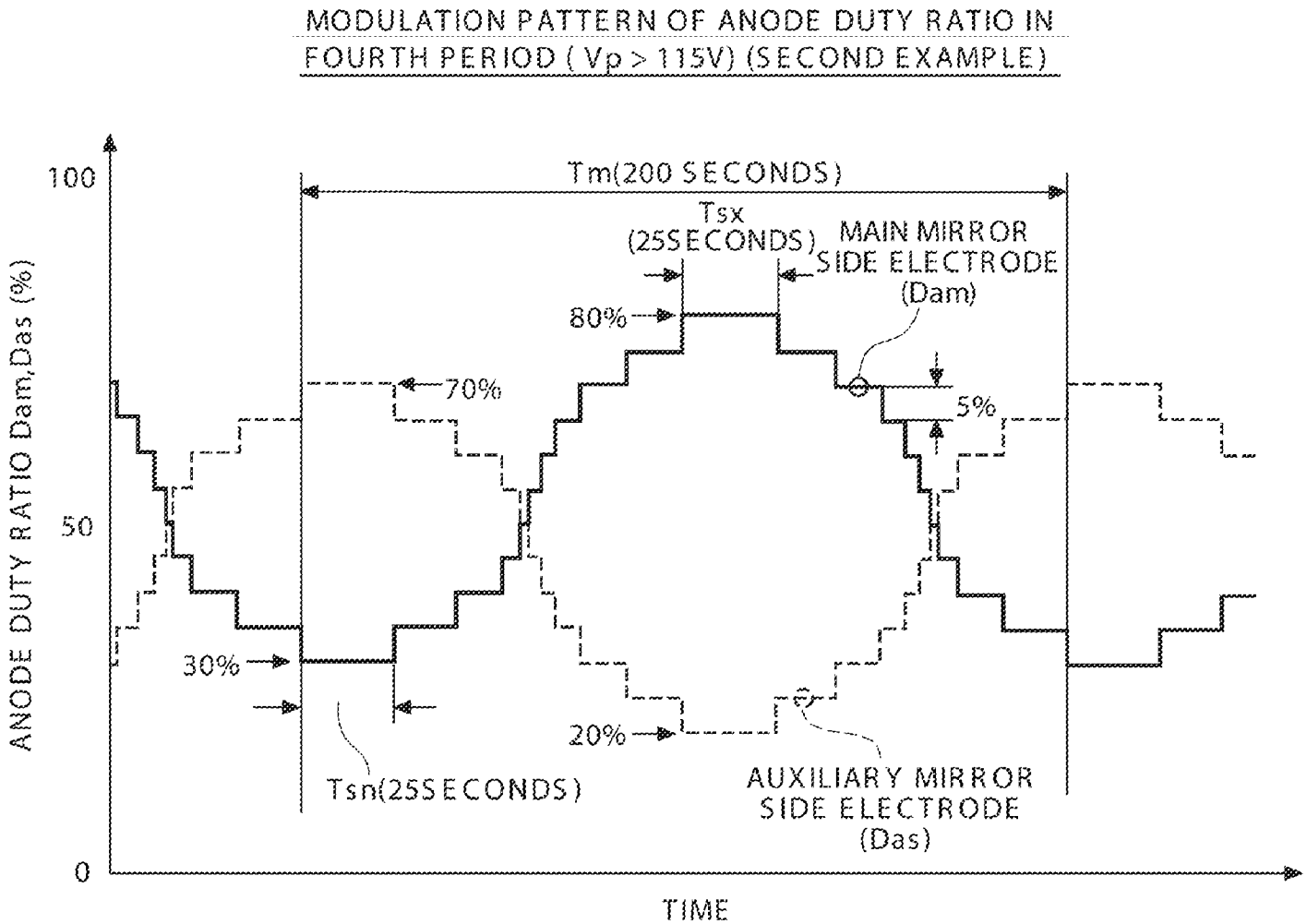
FIG. 16 is an explanatory view illustrating a modulation pattern in a fourth period in the second example.

FIG. 16 illustrates a modulation pattern in a fourth period in which the lamp voltage Vp exceeds 115V. In the fourth period, both the highest duty ratio time Tsx and the lowest duty ratio time Tsn are set to 25 seconds. Also in the fourth period, the number of times (20 times) of change of the anode duty ratios Dam and Das in the modulation period Tm and the change widths (5%) of the anode duty ratios Dam and Das for every change are the same as those in the first period. Therefore, the modulation range (30% to 80%) of the anode duty ratio Dam of the main mirror side electrode 532 in the fourth period is the same as that of the anode duty ratio Dam of the main mirror side electrode 532 in the first period.

Thus, in the second example, both the highest duty ratio time Tsx and the lowest duty ratio time Tsn are set to the same value. In addition, as the lamp voltage Vp rises, the highest duty ratio time Tsx and the lowest duty ratio time Tsn are set to be longer than those in the first period in which the discharge lamp 500 is in an initial state. Accordingly, similar to the first example, re-formation of a projection is accelerated for the discharge lamp 500 that has deteriorated, and the progress of deterioration caused by an excessive temperature increase in the discharge electrodes 532 and 542 is suppressed for the discharge lamp 500 that has not deteriorated yet. As a result, also in the second example, it becomes easy to make the discharge lamp 500 light stably over a longer period of time.

Furthermore, in the second example, the lowest duty ratio time Tsn extends similar to the highest duty ratio time Tsx as the lamp voltage Vp rises. Therefore, in the second to fourth periods for which the lamp voltage Vp is higher, the lowest duty ratio time Tsn, that is, the time for which the anode duty ratio Das of the auxiliary mirror side electrode 542 is set to the maximum value becomes longer than that in the first example. As a result, in the second example, re-formation of a projection in the auxiliary mirror side electrode 542 is accelerated compared with that in the first example.

Moreover, although the change of the anode duty ratios Dam and Das is performed 20 times within the modulation period Tm in the second example, the change of the anode duty ratios Dam and Das may be performed at least twice within the modulation period Tm. Also in this case, it is preferable to set a high duty period for which the anode duty ratio Dam of the main mirror side electrode 532 is set higher, a low duty period for which the anode duty ratio Dam is set lower, and a middle duty period for which the anode duty ratio Dam is set to the middle of those periods. In this case, re-formation of projections of the discharge electrodes 532 and 542 is accelerated by setting the high duty period and the low duty period longer than the middle duty period as the lamp voltage Vp rises. Moreover, when the change of the anode duty ratios Dam and Das is performed three times or more, the period that becomes long corresponding to the lamp voltage Vp may not necessarily be a period for which the anode duty ratio Dam is set to the maximum value or the minimum value.

C. Modifications

In addition, the invention is not limited to the above-described examples or embodiments, but various modifications may be made within the scope without departing from the subject matter or spirit of the invention. For example, the following modifications may also be made.

C1. First Modification

A deterioration state of the discharge lamp 500 is detected using the lamp voltage in the above examples. However, the deterioration state of the discharge lamp 500 may also be detected in other methods. For example, the deterioration state of the discharge lamp 500 may be detected on the basis of occurrence of the arc jump caused by flattening of the projections 538*a* and 548*a* (FIGS. 6A and 6B). Alternatively, the deterioration state of the discharge lamp 500 may be detected on the basis of a decrease in the amount of light caused by deposition of an electrode material on the inner wall of the discharge space 512 (FIG. 2). The occurrence of arc jump or the decrease in the amount of light may be detected using an optical sensor, such as a photodiode, disposed adjacent to the discharge lamp 500.

C2. Second Modification

In the above examples, the lamp voltage, that is, the deterioration state of the discharge lamp 500 is detected and the modulation pattern of the anode duty ratio is changed on the basis of the detection result as shown in FIG. 8. However, the modulation pattern may also be changed on the basis of other conditions. For example, the modulation pattern of the anode duty ratio may be changed when the cumulative lighting time of the discharge lamp 500 measured by the timer 640 exceeds a predetermined reference time (for example, 500 hours). Also in this case, since an excessive temperature increase in a discharge electrode that has not deteriorated yet can be suppressed and formation of a projection can be accelerated for a discharge electrode that has deteriorated, it becomes possible to make the discharge lamp 500 light stably over a longer period of time. In this case, the predetermined reference time may be suitably set on the basis of the life of the discharge lamp 500, an experiment on the progress of deterioration of the discharge electrode, and the like.

C3. Third Modification

In the above examples, the liquid crystal light valves 330R, 330G, and 330B are used as light modulating units in the projector 1000 (FIG. 1). However, other arbitrary modulating units, such as a DMD (digital micromirror device; trademark of Texas Instruments, Inc.), may also be used as the light modulating units. In addition, the invention may also be applied to various kinds of image display devices including a liquid crystal display device, exposure devices, or illuminating devices as long as these devices use discharge lamps as light sources.

The entire disclosure of Japanese Patent Application No. 2008-44433, filed Feb. 26, 2008 is expressly incorporated by reference herein.

What is claimed is:

1. A method for driving a discharge lamp that lights by performing discharge between two electrodes while alternately switching a polarity of a voltage applied between the two electrodes so that an alternating current is supplied to the discharge lamp, the method comprising:

modulating an anode duty ratio of the alternating current applied to the discharge lamp, which is a ratio of an anode time for which one of the electrodes operates as an anode in one period of the polarity switching, by setting first and second periods with different anode duty ratios; and setting the first period, in which the anode duty ratio of the alternating current applied to the discharge lamp is higher than that in the second period, longer than the second period in one modulation period, which includes the first and second periods and for which the modulation is performed, when a predetermined condition is satisfied.

2. The method for driving a discharge lamp according to claim 1, wherein the one modulation period includes a third period in which the anode duty ratio is lower than that in the second period, and the third period is set longer than the second period in the one modulation period when the predetermined condition is satisfied.

3. The method for driving a discharge lamp according to claim 1, wherein the discharge lamp has a condition in which an operating temperature of one of the two electrodes is higher than that of the other electrode, and an anode duty ratio in the one electrode is set to be lower than that in the other electrode.

4. The method for driving a discharge lamp according to claim 3, wherein the discharge lamp has a reflecting mirror that reflects light emitted between the electrodes toward the other electrode side.

5. The method for driving a discharge lamp according to claim 1, wherein the predetermined condition is satisfied when a cumulative lighting time of the discharge lamp exceeds a predetermined reference time.

6. The method for driving a discharge lamp according to claim 1, further comprising:

detecting a deterioration state of the electrode according to the use of the discharge lamp; and determining whether or not the predetermined condition is satisfied on the basis of the deterioration state.

7. The method for driving a discharge lamp according to claim 6, wherein the deterioration state is detected on the basis of a voltage applied between the two electrodes in supplying predetermined power between the two electrodes.

8. The method for driving a discharge lamp according to claim 1, wherein the period of the polarity switching is maintained as a constant value within the one modulation period for which the modulation is performed.

9. A driving device for a discharge lamp, comprising:

a discharge lamp lighting unit that makes the discharge lamp light by supplying the power between two electrodes of the discharge lamp; and a power supply control unit that controls a power supply state of the discharge lamp lighting unit, the discharge lamp lighting unit including a polarity switching portion that alternately switches a polarity of a voltage applied between the electrodes so that an alternating current is supplied to the discharge lamp, and the power supply control unit including:

an anode duty ratio modulating portion that modulates an anode duty ratio of the alternating current applied to the discharge lamp, which is a ratio of an anode time for which one of the electrodes operates as an anode in one period of the polarity switching, by setting first and second periods with different anode duty ratios; and a high duty period extending portion that sets the first period, in which the anode duty ratio of the alternating current applied to the discharge lamp is higher than that in the second period, longer than the second period in one modulation period, which includes the first and second periods and for which the modulation is performed, when a predetermined condition is satisfied.

10. A light source device, comprising:

a discharge lamp;

a discharge lamp lighting unit that makes the discharge lamp light by supplying the power between two electrodes of the discharge lamp so that an alternating current is supplied to the discharge lamp; and a power supply control unit that controls a power supply state of the discharge lamp lighting unit, the discharge lamp lighting unit including a polarity switching portion that alternately switches a polarity of a voltage applied between the electrodes, and the power supply control unit including:

an anode duty ratio modulating portion that modulates an anode duty ratio of the alternating current applied to the discharge lamp, which is a ratio of an anode time for which one of the electrodes operates as an anode in one period of the polarity switching, by setting first and second periods with different anode duty ratios; and a high duty period extending portion that sets the first period, in which the anode duty ratio of the alternating current applied to the discharge lamp is higher than that in the second period, longer than the second period in one modulation period, which includes the first and second periods and for which the modulation is performed, when a predetermined condition is satisfied.

11. An image display device, comprising:

a discharge lamp that is a light source for image display;

a discharge lamp lighting unit that makes the discharge lamp light by supplying the power between two electrodes of the discharge lamp so that an alternating current is supplied to the discharge lamp; and a power supply control unit that controls a power supply state of the discharge lamp lighting unit, the discharge lamp lighting unit including a polarity switching portion that alternately switches a polarity of a voltage applied between the electrodes, and the power supply control unit including:

an anode duty ratio modulating portion that modulates an anode duty ratio of the alternating current applied to the discharge lamp, which is a ratio of an anode time for which one of the electrodes operates as an anode in one period of the polarity switching, by setting first and second periods with different anode duty ratios; and a high duty period extending portion that sets the first period, in which the anode duty ratio of the alternating current applied to the discharge lamp is higher than that in the second period, longer than the second period in one modulation period, which includes the first and second periods and for which the modulation is performed, when a predetermined condition is satisfied.

* * * * *